US008959680B2

(12) United States Patent
Tesar et al.

(10) Patent No.: US 8,959,680 B2
(45) Date of Patent: Feb. 24, 2015

(54) POSITIONING MECHANISM OF A BED

(75) Inventors: Milan Tesar, Slany (CZ); Vladmir Kolar, Slany (CZ)

(73) Assignee: Linet Spol. S.R.O., Slany (CZ)

( * ) Notice: Subject to any disclaimer, the term of this patent is extended or adjusted under 35 U.S.C. 154(b) by 907 days.

(21) Appl. No.: 12/901,033

(22) Filed: Oct. 8, 2010

(65) Prior Publication Data

US 2011/0094031 A1 Apr. 28, 2011

Related U.S. Application Data

(63) Continuation-in-part of application No. 12/867,166, filed on Aug. 11, 2010, now Pat. No. 8,112,836.

(30) Foreign Application Priority Data

Feb. 15, 2008 (CZ) ..... PUV 2008-19673
Feb. 12, 2009 (WO) ..... PCT/CZ2009/000015

(51) Int. Cl.
*A61G 7/005* (2006.01)
*A61G 7/008* (2006.01)

(52) U.S. Cl.
CPC ..... *A61G 7/008* (2013.01); *A61G 7/005* (2013.01); *A61G 2203/44* (2013.01)
USPC ..... 5/608; 5/607; 5/609; 5/610

(58) Field of Classification Search
USPC ..... 5/607–610
See application file for complete search history.

(56) References Cited

U.S. PATENT DOCUMENTS 3,393,004 A * 7/1968 Williams ..... 296/20
3,814,414 A * 6/1974 Chapa ..... 5/601
4,953,244 A * 9/1990 Koerber et al. ..... 5/600
5,157,787 A * 10/1992 Donnellan et al. ..... 5/610
7,176,391 B2 * 2/2007 Metz et al. ..... 177/144
7,373,676 B2 * 5/2008 Markovic et al. ..... 5/601
2002/0066142 A1 * 6/2002 Osborne et al. ..... 5/600
2007/0192960 A1 * 8/2007 Jackson ..... 5/618
2008/0000028 A1 * 1/2008 Lemire et al. ..... 5/618
2011/0010858 A1 1/2011 Tesar et al.

FOREIGN PATENT DOCUMENTS

DE 4341799 A1 6/1995
GB 2305419 A 4/1997
JP 02 257952 A 10/1990
WO 2007/145544 A1 12/2007
WO 2009/100692 A1 8/2009

OTHER PUBLICATIONS

International Search Report and Written Opinion to corresponding International Application No. PCT/CZ2009/000015 mailed on May 21, 2010 of parent case (i.e., U.S. Appl. No. 12/867,166).

* cited by examiner

*Primary Examiner* — Peter M Cuomo
*Assistant Examiner* — Ifeolu Adeboyejo
(74) *Attorney, Agent, or Firm* — Nelson Mullins Riley & Scarborough, LLP

(57) ABSTRACT

A positioning mechanism of a bed is disclosed. In one such embodiment, a bed can comprise an undercarriage frame, a patient surface frame, a plurality of lifters, and at least one load cell in communication with the patient surface frame. Such a load cell can be adapted to communicate a signal associated with a force exerted from the patient surface frame. The force exerted from the patient surface frame is perpendicular to the load cell when the patient surface frame is oblique to the undercarriage frame.

16 Claims, 9 Drawing Sheets

POSITIONING MECHANISM OF A BED

CROSS-REFERENCE TO RELATED APPLICATIONS

This application is a continuation-in-part of U.S. patent application Ser. No. 12/867,166, filed Aug. 11, 2010, which is a 35 U.S.C. §371 national stage filing of International Application No. PCT/CZ2009/000015, filed Feb. 12, 2009, which claims priority to Czech Republic Patent Application No. PUV 2008-19673, filed Feb. 15, 2008, the priority benefit of each of which is claimed by this application, and the contents of each of which are incorporated in their entirety herein by reference.

FIELD

The present invention relates to a positioning mechanism of a patient care bed, and more particularly, to a patient care bed having a force or weight sensor.

BACKGROUND

Within the care of lying patients it is advantageous if the hospital bed enables side tilt of the patient surface of the bed besides other positions. For therapeutic purposes a min.±30° side tilt is required. However, at such tilt there is a problem of collision of individual parts of the patient surface with the undercarriage. To prevent a collision, it is usually necessary to lift the bed horizontally and only then it can be tilted sideways. Therefore, known tilting mechanisms usually raise the lowest possible position of the patient surface in the horizontal position. For these reasons the used electronic installation is relatively complicated and the absolute position of the height of the patient surface must be sensed and collision statuses must be evaluated.

So far, for the height adjustment of patient surfaces of tilting and positioning hospital beds mostly linear telescopic systems with two or four lifters have been used. The use of more than two telescopic extensible lifters to control the height of the patient surface and its further positioning brings problems in the possibility of the mechanisms colliding in some positions.

Another disadvantage of this design is structural complexity and the resulting high investment demands of the existing tilting and positioning beds.

Another disadvantage of known solutions is the problematic combination of setting the side tilt and Trendelenburg and anti-Trendelenburg position, i.e., tilting the patient surface around the transversal axis.

Yet another disadvantage of known hospital bed designs is that when the patient surface is tilted or positioned obliquely, the measured weight of a patient is inaccurate because the direction of the weight force is not perpendicular to sensors that measure patient weight.

Therefore, the goal of the invention is to design such a positioning mechanism of a bed that minimizes the above-mentioned shortcomings.

SUMMARY

The above mentioned goal is achieved with a positioning mechanism of a bed comprising at least two height adjustable lifters arranged in a distance from each other that are mounted on the undercarriage frame at one side and connected to the patient surface frame at the other side, in accordance with an invention the principle of which consists in the fact that the first lifter is arranged in such a way that its axis intersects the longitudinal axis of the patient surface frame and the first lifter is connected to the patient surface frame in a swinging way around the longitudinal axis of the patient surface frame and in a sliding way in the direction of the longitudinal axis of the patient surface frame. The second lifter and the third lifter are interconnected with an arm, oriented transversally to the longitudinal axis of the patient surface frame and the arm is connected to the patient surface frame in a swinging way. The arm is connected at one end to the second lifter both in a swinging way around the axis, in parallel with the longitudinal axis of the patient surface frame and in a sliding way transversally to the patient surface frame. At the other end the arm is connected to the third lifter, in a swinging way around the axis, in parallel with the longitudinal axis of the patient surface frame.

Such a design of the positioning mechanism of a bed reduces stressing of the lifters by horizontal components of the load, minimizes the installation height of the mechanism, makes it possible to tilt the patient surface frame from the bottom position of the lifters already as there is no danger of collision of the patient surface frame with the undercarriage frame.

In a beneficial embodiment the first lifter at its top end carries at least one horizontal first guide in which the first slider is mounted in a sliding way. The first slider is connected to a yoke in a swinging way while the yoke is connected to the patient surface frame in a swinging way. The second lifter carries at its top end at least one second guide in which at least one second slider is mounted in a sliding way that is connected with a pin to one end of the arm while the third lifter is connected to the opposite end of the arm with a pin.

In accordance with a preferred embodiment the distance between the axes of the pins arranged at the opposite ends of the arm is bigger than the distance between the longitudinal axes of the second and third lifter. This version reduces vertical forces loading the lifter during side loading of the patient surface, especially in case of a lateral tilt.

To facilitate movement control under the undercarriage frame and patient surface frame position sensors with an opposite cam are arranged. The use of such simple end sensors for the control of the zero position and the maximum tilt replaces complicated position measurements of each filter.

Another embodiment of the present invention can comprise an undercarriage frame, a plurality of lifters comprising first and second ends, a patient surface frame coupled with the second ends of the lifters, and at least one load cell in communication with the patient surface frame. The first ends of the lifters can be coupled with the undercarriage frame. The load cell can be adapted to communicate a signal associated with a force exerted from the patient surface frame. The force exerted from the patient surface frame is perpendicular to the load cell in a first position and a second position. In one embodiment, the patient surface frame is parallel to the undercarriage frame in the first position and oblique to the undercarriage frame in the second position.

At least one flange can depend from each one of the plurality of lifters. The flanges are parallel to the undercarriage frame in the first and second positions. At least one load cell can be coupled with one of the flanges.

Another embodiment of the present invention can comprise an undercarriage frame, a patient surface frame opposite the undercarriage frame, a plurality of height-adjustable lifters disposed between the undercarriage frame and the patient surface frame, and at least one load-cell-supporting surface disposed parallel to the undercarriage frame and coupled with the second end of one of the plurality of height-adjustable lifters.

Each of the plurality of height-adjustable lifters can comprise a first end coupled with the undercarriage frame and a second end coupled with the patient surface frame. The plurality of height-adjustable lifters can be configured to move the patient surface frame with respect to the undercarriage frame in a predetermined range of motion. The load-cell-supporting surface remains parallel to the undercarriage frame throughout the range of motion. In one embodiment, the range of motion can comprise a position of the patient surface frame oblique to the undercarriage frame.

A load cell can be disposed in communication with the load-cell-supporting surface. Alternatively, the load cell can be coupled with the load-cell-supporting surface. The load cell can be adapted to communicate a signal associated with a force exerted from the patient surface frame.

The plurality of height-adjustable lifters can comprise a first height-adjustable lifter, a second height-adjustable lifter, and a third height-adjustable lifter. The height-adjustable lifters can be configured to move independently of one another. The first height-adjustable lifter can intersect a longitudinal axis of the patient surface frame.

The second end of the first height-adjustable lifter can comprise a substantially planar cover plate and first and second flanges depending from the cover plate. A yoke can be pivotably coupled with the patient surface frame and slidably coupled with the second end of the first height-adjustable lifter. The yoke can be configured to reciprocate axially with respect to the longitudinal axis of the patent surface frame.

Each of the first and second flanges of the first height-adjustable lifter can comprise a load-cell supporting surface. The load-cell-supporting surfaces of the first and second flanges can be coplanar with one another. The load-cell-supporting surfaces of the first and second flanges can be parallel to the cover plate.

The second end of the second height-adjustable lifter can comprise a substantially planar cover plate and a flange depending from the cover plate. The flange can comprise a load-cell-supporting surface. The second end of the third height-adjustable lifter can comprise a substantially planar cover plate and a flange depending from the cover plate. The flange can comprise a load-cell-supporting surface. The load-cell-supporting surfaces of the second and third height-adjustable lifters are parallel to the undercarriage frame.

The second and third height-adjustable lifters can be coupled by an arm disposed transversely to the longitudinal axis of the patient surface frame. The arm can be coupled with the patient surface frame. One end of the arm can be pivotably and slidably coupled with the second end of the height-adjustable lifter and an opposite end of the arm can be pivotably coupled with the second end of the third height-adjustable lifter.

The present invention can include a method of making a bed configured to move within a predetermined range of motion. Such a method can comprise providing an undercarriage frame, providing at least two lifters, providing a patient surface frame opposite the undercarriage frame, and providing a load-cell-supporting surface parallel to the undercarriage frame. The load-cell-supporting surface remains parallel with respect to the undercarriage frame throughout the range of motion. In one embodiment, the range of motion comprises a position of the patient surface frame oblique to the undercarriage frame.

Each of the lifters can comprise a first end and a second end. The method also can comprise coupling the first ends of the lifters with the undercarriage frame and coupling the second ends of the lifters with the patient surface frame. The method can further comprise providing at least one load cell in communication with the load-cell-supporting surface. The load cell can be adapted to communicate a signal associated with a force exerted from the patient surface frame.

The present invention may be better understood by reference to the description and figures that follow. It is to be understood that the invention is not limited in its application to the specific details as set forth in the following description, figures, and claims. The invention is capable of other embodiments and of being practiced or carried out in various ways.

BRIEF DESCRIPTION OF THE DRAWINGS

The positioning mechanism of a bed in accordance with the invention will be described in a more detailed way with the use of a sample of a particular embodiment illustrated in the attached drawings where individual figures show.

DETAILED DESCRIPTION OF THE EXEMPLARY EMBODIMENT

Figure 1:
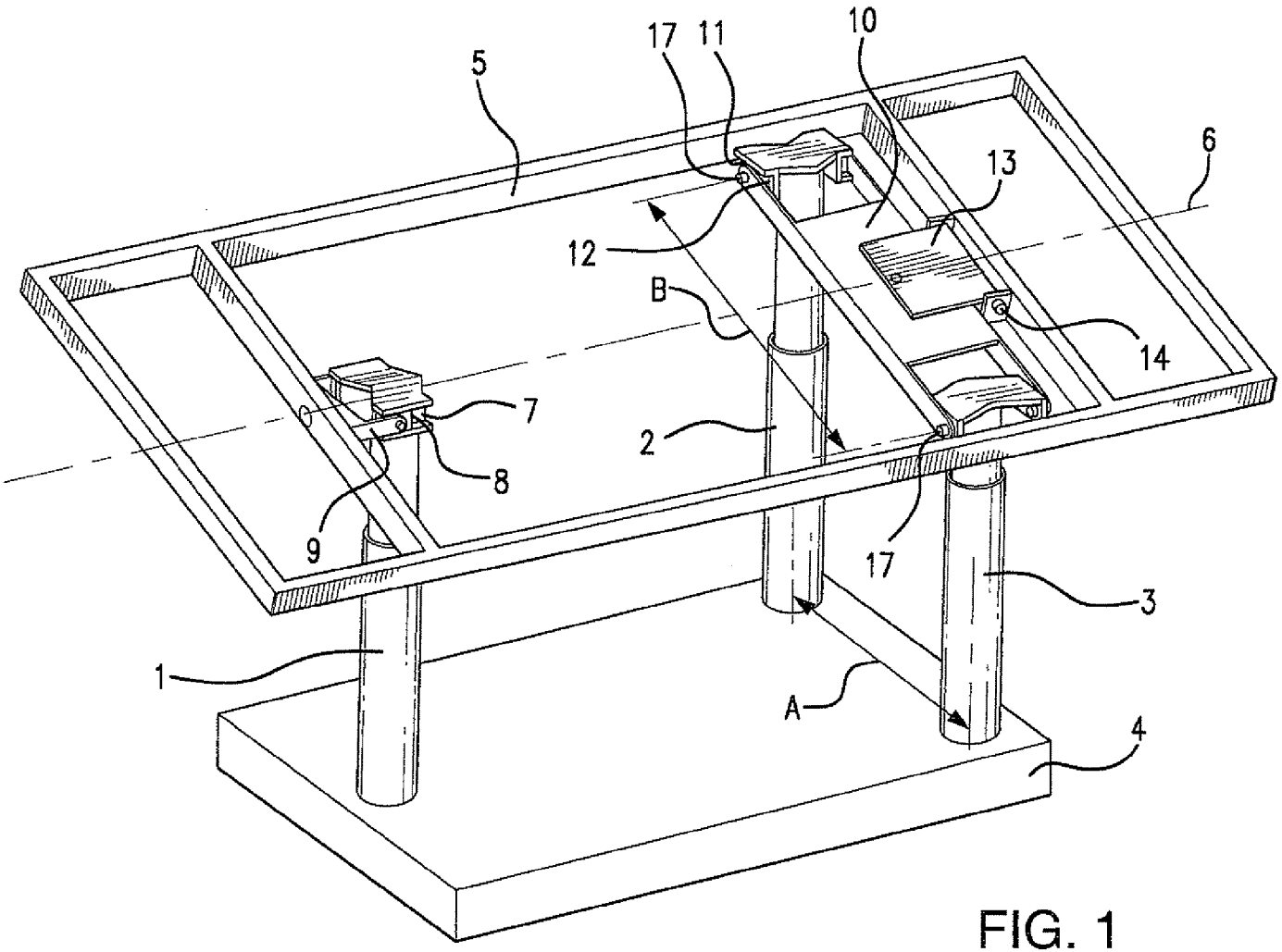
FIG. 1 is a schematic drawing of the positioning mechanism of a bed.
Figure 2:
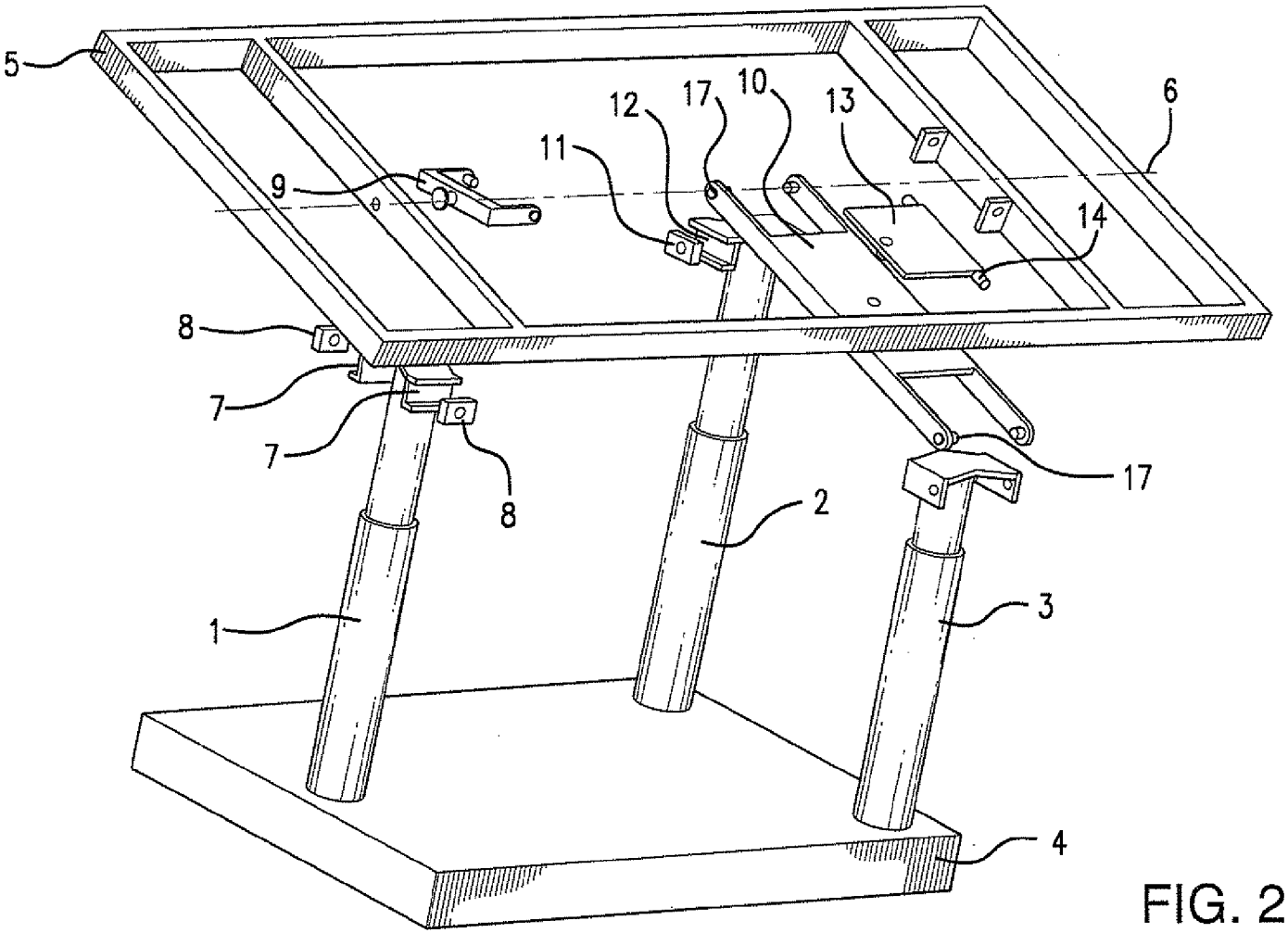
FIG. 2 shows the positioning mechanism from FIG. 1 in an expanded view.

FIGS. 1 and 2 show a sample embodiment of the positioning mechanism of a bed in accordance with the invention comprising three height adjustable lifters 1, 2, 3 that are mounted on the undercarriage frame 4 at one side and at the other side are connected to the frame 5 of the patient surface of the bed.

The lifters 1, 2, 3 are height adjustable with the use of electric motors that are not shown here.

The lifters 1, 2, 3 can have any design known from the art. As an example the telescopic lifter described in the utility model no. CZ6654 can be mentioned.

The first lifter 1 is arranged on the undercarriage frame 4 vertically in such a way that the axis of the first lifter 1 intersects the longitudinal axis 6 of the patient surface frame 5. The first lifter 1 carries at its top end two horizontal first guides 7 in which two first sliders 8 are mounted in a sliding way. The first two sliders 8 are connected in a swinging way with the use of pins to the opposite arms of the yoke 9 that is connected to the frame 5 of the patient surface in such a way that it can swing around the longitudinal axis 6 of the patent surface frame 5.

The second lifter 2 and the third lifter 3 are interconnected with an arm 10 oriented transversally to the longitudinal axis 6 of the patient surface frame 5.

The second lifter 2 carries at its top end two second guides 12 in which two second sliders 11 are mounted in a sliding way while the sliders 11 are connected in a swinging way to one end of the arm 10 and the third lifter 3 is connected to the opposite end of the arm 10 with a pin.

In the middle, the arm 10 is connected with the use of a plate 13 and a pin 14 to the patient surface frame 5 while the shaft 14 is oriented transversally to the longitudinal axis 6 of the patient surface frame 5.

The arm 10 is connected to the top end of the second and third lifter 2, 3 in such a way that the distance B between the axes of the pins 17 arranged at the opposite ends of the arm 10 is bigger than the distance A between the longitudinal axes of the second and third lifter 2, 3. It is not usually possible to increase the axial distances A of the lifters as during a side tilt of the patient surface frame 5 a collision with the undercarriage frame 4 would occur. The more the distance B between the axes of the pins 17 approximates the width of the patient surface frame 5, the smaller is the danger that during a side tilt the patient surface frame 5 will collide with the undercarriage frame 4.

On the patient surface frame 5 four position sensors 15 are installed against which a cam 16 is mounted. The position sensors 15 are common end sensors.

Depending on the mutual extension and retraction of individual lifters 1, 2, 3 the frame 5 of the patient surface can be raised, lowered and tilted both around the transversal axis and around the longitudinal axis 6.

To achieve transversal tilt of the patient surface frame 5 around the longitudinal axis 6 the second lifter 2 and the third lifter 3 are put in counter-motion.

Figure 3:
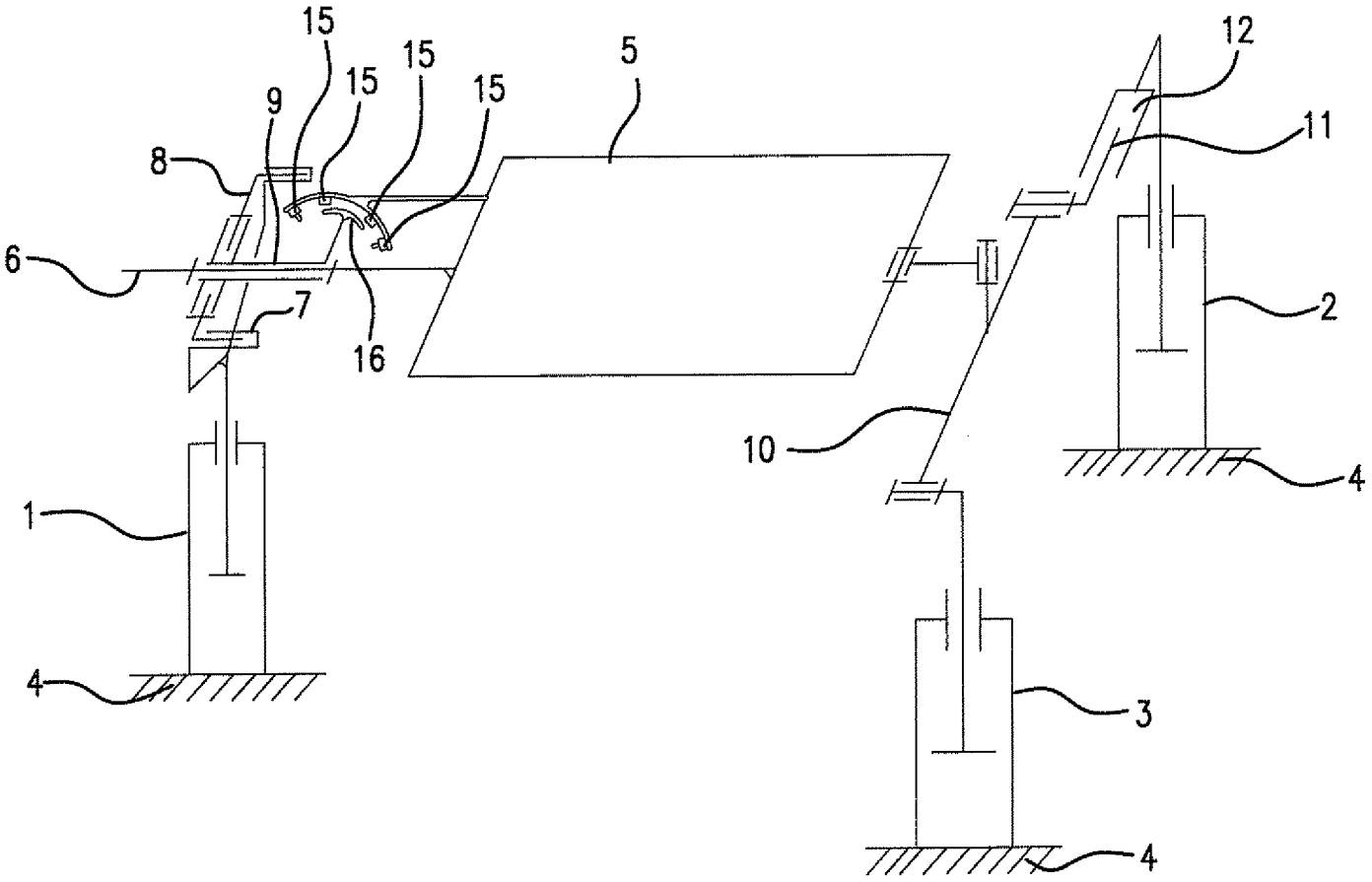
FIG. 3 is a kinematic diagram.

At the beginning of the transversal tilt of the patient surface frame 5 the mutual position of the cam 16 and sensors 15 changes (see FIG. 3). In the first stage the two intermediate position sensors 15 indicate that the patient surface frame 5 has been tilted transversally and to which side. The achievement of the maximum tilt of the patient surface frame 5 to one or the other side is signalized by the two end position sensors 15.

Undesired forces that caused bending stress of the lifters 1, 2, 3 during the tilt of the patient surface frame 5 are minimized by movements of the sliders 8, 11 in the guides 7, 12.

The positioning mechanism in accordance with the invention is mainly used for hospital beds.

Referring now to FIGS. 4-9, an alternate embodiment of a patient surface frame 100 according to the present invention is shown. The patient surface frame 100 can form a part of a patient care or hospital bed as that shown in FIGS. 1-3. Portions of the bed that are not shown in FIGS. 4-9 will be described with reference to the above description and to FIGS. 1-3.

The patient surface frame 100 can be disposed opposite an undercarriage frame (not shown), such as the undercarriage frame 4. The patient surface frame 100 can include a plurality of structural frame members, such as a first axial frame member 110, a second axial frame member 120, a first lateral frame member 130, a second lateral frame member 140, and a supporting assembly 150. The first and second axial frame members 110, 120 can be disposed parallel to one another. The first and second lateral frame members 130, 140 can be disposed parallel to one another and perpendicular to the first and second axial frame members 110, 120.

The supporting assembly 150 can be coupled with and supported by the first and second axial frame members 110, 120 and can be configured to support patient bedding (not shown). As used herein, terms such as "coupled," "connected," "supported," or "attached" include both direct and indirect linking or joining.

A plurality of lifters (not shown), can be disposed between the undercarriage frame and the patient surface frame 100. As described above with reference to lifters 1, 2, 3 shown in FIGS. 1-3, the plurality of lifters can be telescoping or height-adjustable lifters. In one embodiment, there can be at least two lifters. In another embodiment there can be three lifters. The lifters can each include a first end coupled with the undercarriage frame. A second end of each of the lifters can be disposed opposite the first end, and coupled with the patient surface frame 100.

As described above, the lifters are configured to move independently of one another so that the patient surface frame 100 can move or tilt with respect to the undercarriage frame and rotate about its longitudinal axis in a predetermined range of motion. For example, in a first position the patient surface frame 100 can be parallel to the undercarriage frame and in a second position the patient surface frame 100 can be oblique to the undercarriage frame.

As discussed above, the range of motion of the patient surface frame 100 can include Trendelenburg positions as well as reverse Trendelenburg, or anti-Trendelenburg, positions. As is well known, a Trendelenburg position refers to a position in which the feet of a supine individual are higher than the head. In a reverse Trendelenburg, or anti-Trendelenburg, position, the head of a supine individual is higher than the feet. Also as discussed above, the range of motion of the patient surface frame 100 additionally can include side, or lateral, tilting about the longitudinal axis of the patient surface frame 100. Throughout the range of motion of the patient surface frame 100, the undercarriage frame can remain stationary.

Figure 4:
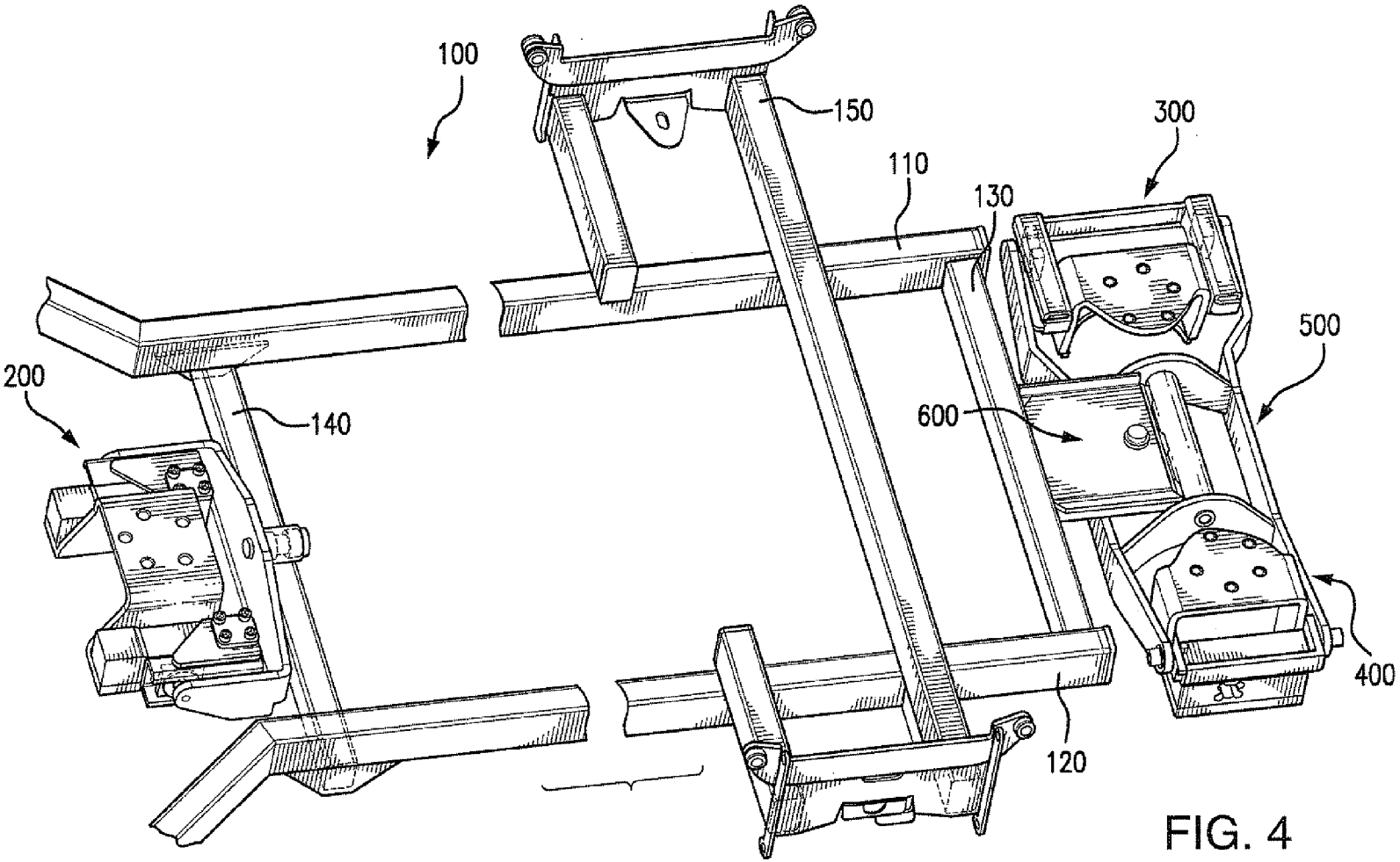
FIG. 4 is a perspective view of an alternate embodiment of a patient surface frame according to the present invention.
Figure 5:
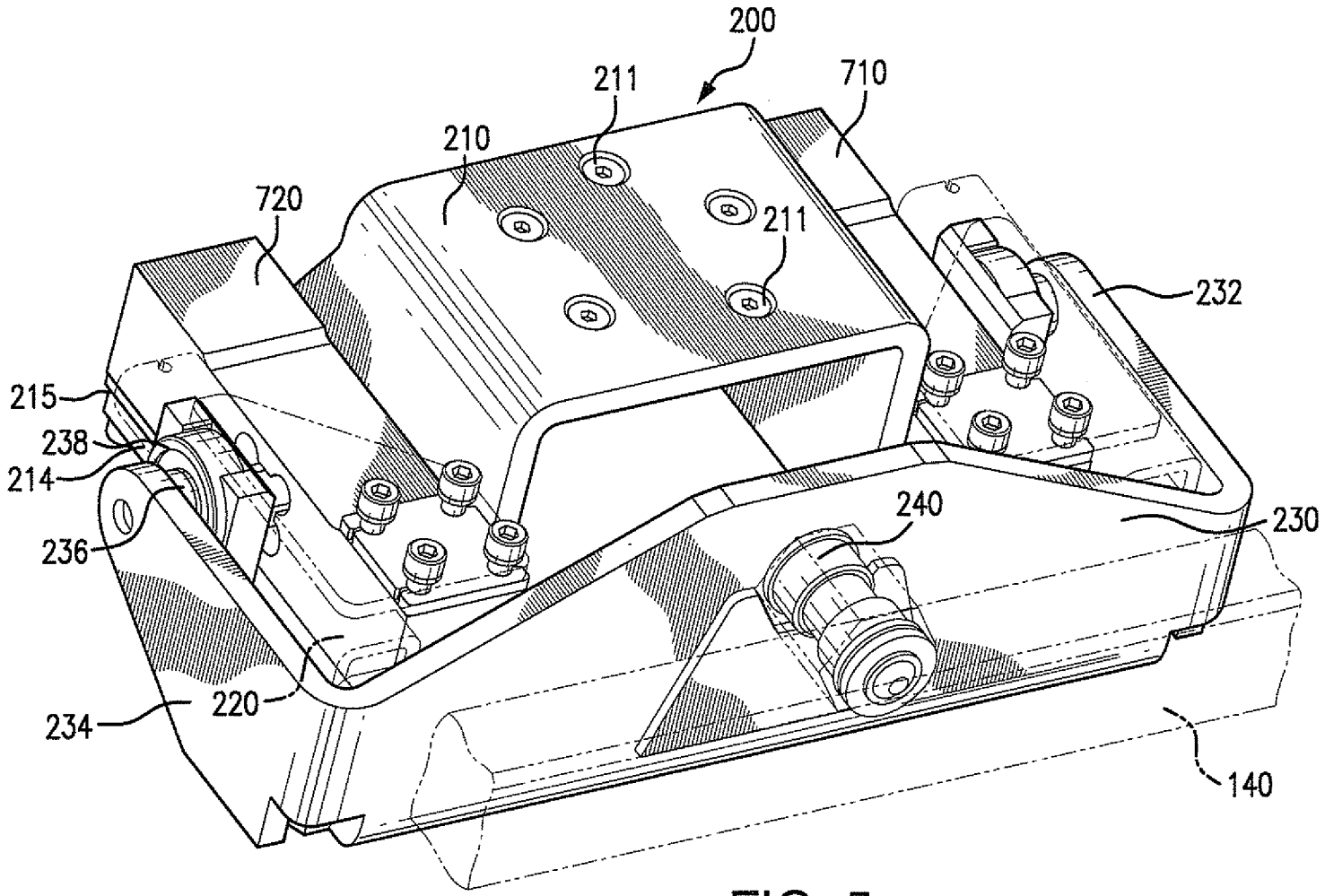
FIG. 5 is a perspective view of a first lifter head assembly of the patient surface frame of FIG. 4.
Figure 6:
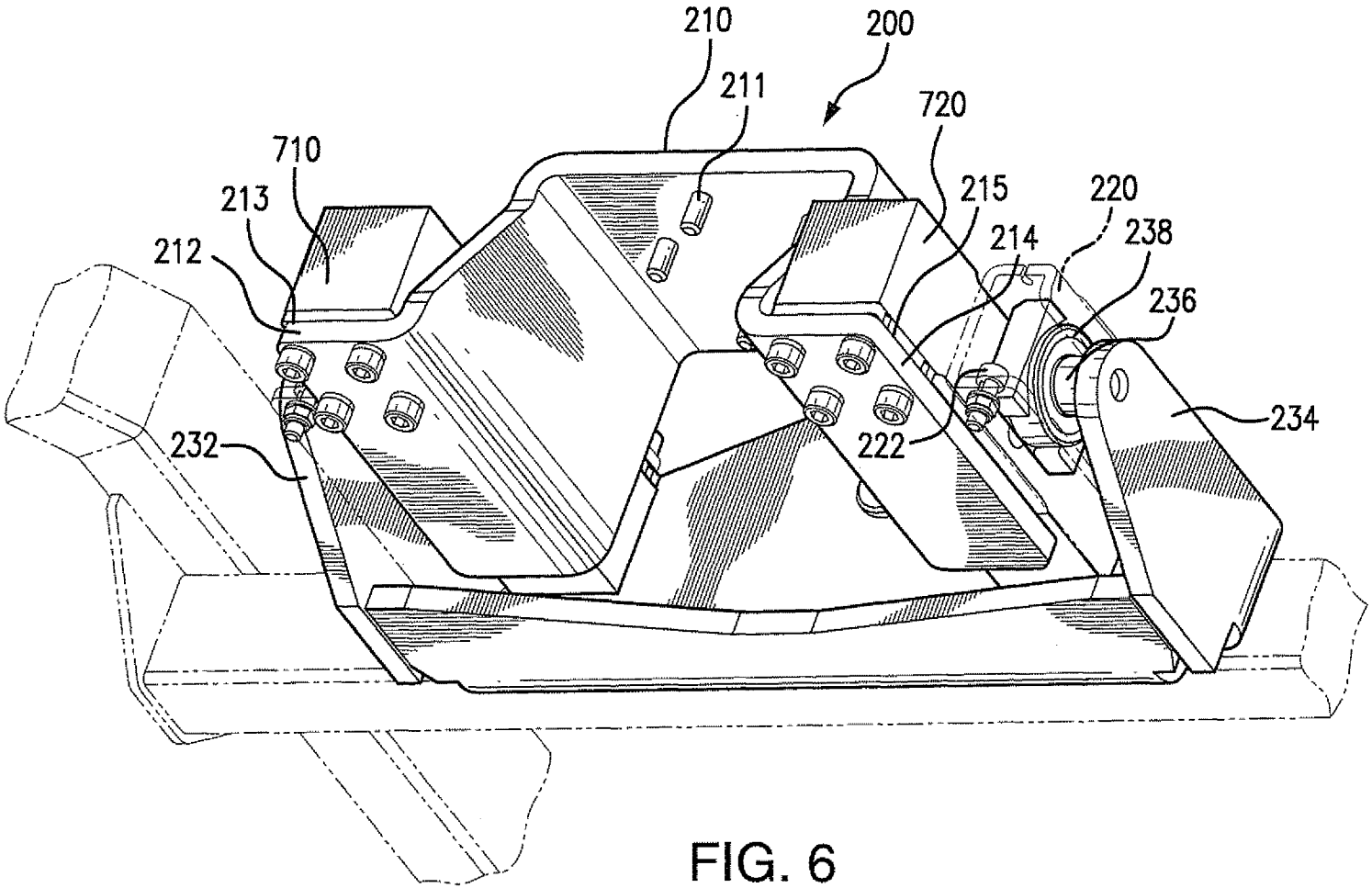
FIG. 6 is another perspective view of the first lifter head assembly of FIG. 5.

Referring now to FIGS. 4-6, a first lifter head assembly 200 can be coupled with the second end of the first lifter (not shown). As described above, the first lifter intersects the longitudinal axis of the patient surface frame 100. The first lifter head assembly 200 can include a substantially planar cover plate 210. The cover plate 210 can be parallel to the undercarriage frame. The cover plate 210 can be fixedly attached to the second end of the first lifter by one or more mechanical fasteners 211, such as rivets, screws, or pins. The cover plate 210 can also be attached to the first lifter by welding. Other suitable methods of attachment or connection can be used. Alternatively, the cover plate 210 can be integrally formed with the first lifter.

As better seen in FIG. 6, a first flange 212 and a second flange 214 depend from the cover plate 210. The first flange 212 and the second flange 214 can be integrally formed with the cover plate 210. Alternatively, the cover plate 210, the first flange 212 and the second flange 214 can be separate components that are coupled together.

The first flange 212 can include a load-cell-supporting surface 213, and the second flange 214 can include a load-cell-supporting surface 215. Thus, the load-cell-supporting surfaces 213, 215 can be coupled with the second end of the first lifter. The load-cell-supporting surface 213 of the first flange 212 and the load-cell-supporting surface 215 of the second flange 214 can be parallel to the cover plate 210 and to the undercarriage frame. The load-cell-supporting surface 213 of the first flange 212 and the load-cell-supporting surface 215 of the second flange 214 can be coplanar.

A first load cell 710 can be disposed in communication with the load-cell-supporting surface 213 of the first flange 212. As used herein, terms such as "communicate" or "communication" mean to mechanically, electrically, optically, or otherwise couple, contact, or connect by either direct, indirect, or operational means.

In another embodiment, the first load cell 710 can be coupled with the load-cell-supporting surface 213. Alternatively, the first load cell 710 can be supported by and fixedly attached to the load-cell-supporting surface 213. The first load cell 710 can be adapted to communicate a signal associated with a force exerted from the patient surface frame 100.

Load cells are known and generally include a plurality of sensors, (for example, strain gauges) disposed within a metal block. A suitable load cell is commercially available from Soehnle Professional GmbH & Co. KG as model number SEB46C. Other suitable load cells can be used.

Analog signals from the plurality of sensors of the first load cell 710 can be communicated to a multi-channel Analog-to-Digital (A/D) converter (not shown). AD7794 sold by Analog Devices in Norwood, Mass. can be used. The A/D converter can have a single output. Digital signals from the A/D converter can be input to a controller (not shown). The controller uses digital signals to calculate the force exerted from the patient surface frame 100 and sensed by at least the first load cell 710. Patient weight can be calculated very simply from the force exerted from the patient surface frame 100.

It should be noted that unlike known systems, calculating patient weight as described herein does not require determining an angle of alignment of the patient surface frame 100 (that is, the movable frame) to correct the force measured and to generate a corrected weight, because the weight force of the patient is perpendicular to the load-cell-supporting surface 213, and thus to the first load cell 710, regardless of the position of the patient surface frame 100. Thus, the measured patient weight is accurate throughout the range of motion of the patient surface frame 100.

In one embodiment, only one load cell is used. With larger surface areas, however, more accurate or uniform readings may be obtained with multiple load cells. Where multiple load cells are used, the controller does not calculate a ratio based on a percentage of weight at each load cell. Instead, the controller calculates the total force sensed by the load cells.

A second load cell 720 can be disposed in communication with the load-cell-supporting surface 215 of the second flange 214 of the first lifter head assembly 200. In another embodiment, the second load cell 720 can be coupled with the load-cell-supporting surface 215. Alternatively, the second load cell 720 can be supported by and fixedly attached to the load-cell-supporting surface 215. As described above with reference to the first load cell 710, the second load cell 720 also can be adapted to communicate a signal associated with a force exerted from the patient surface frame 100.

Referring now to FIG. 5, the first lifter head assembly 200 can be coupled with a yoke 230. The yoke 230 and the second lateral frame member 140 of the patient surface frame 100 can be pivotably coupled by pin 240. The pinned connection allows the patient surface frame 100 to rotate or tilt about its longitudinal axis.

The yoke 230 can be slidably coupled with the second end of the first lifter. The yoke 230 can include a first arm 232 and a second arm 234. The first arm 232 and the second arm 234 can be parallel to one another. The connection of the first and second arms 232, 234 to the first lifter head assembly 200 are substantially similar. Therefore, only the connection of the second arm 234 will be described.

The second arm 234 can be attached to a bearing assembly 238 with a pin 236. The bearing assembly 238 can be configured to reciprocate within a channel 220. The channel 220 can be connected to or formed integrally with the first lifter head assembly 200. Travel of the bearing assembly 238 can be guided by the channel 220. Travel of the bearing assembly 238 can be limited by the yoke 230 at one end of the channel 220 and a bearing limiter 222 at the opposite end of the channel 220. The bearing limiter 222 can be a rivet, screw, or pin. Other suitable means for arresting or limiting the travel of the bearing assembly 238 can be used.

The load-cell-supporting surfaces 213, 215 are thus configured to remain parallel to the undercarriage frame as the patient surface frame 100 moves and rotates with respect to the undercarriage frame throughout a range of motion, which includes both horizontal and non-horizontal positions of the patient surface frame 100. Therefore, the force exerted from the patient surface frame 100 is perpendicular to each of the load-cell-supporting surfaces 213, 215, and thus to each of the load cells 710, 720, not only when the patient surface frame 100 is parallel to the undercarriage frame, but also when the patient surface frame 100 is oblique to the undercarriage frame. Thus, the patient weight measured by each of the load cells 710, 720 is accurate regardless of the position of the patient surface frame 100 without the need to correct the force measured or to calculate a corrected weight.

Figure 7:
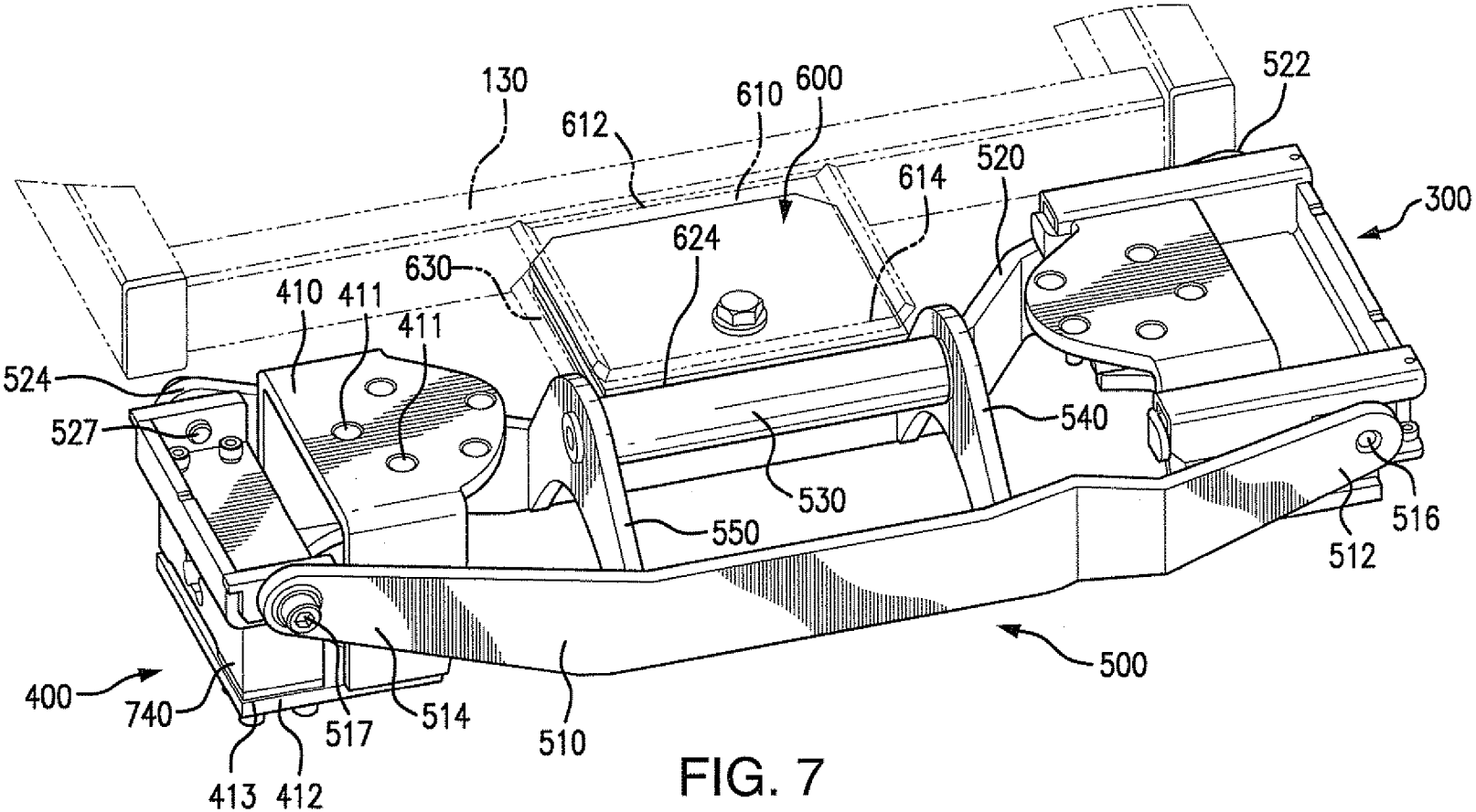
FIG. 7 is a perspective view of second and third lifter head assemblies of the patient surface frame of FIG. 4.

Referring again to FIG. 4, a second lifter head assembly 300 and a third lifter head assembly 400 are disposed opposite the first lifter head assembly 200. Referring now to FIG. 7, a perspective view of the second and third lifter head assemblies 300, 400 is shown. The second and third lifter head assemblies 300, 400 can be coupled with one another by first linkage 510 and second linkage 520 of arm 500.

The arm 500 can be oriented transversely to the longitudinal axis of the patient surface frame 100. The arm 500 can include the first linkage 510 and the second linkage 520. Disposed between the first and second linkages 510, 520 can be a shaft 530. Opposing ends of the shaft 530 can be coupled with a first support 540 and a second support 550. Opposing ends of the first support 540 can be coupled with the first and second linkages 510, 520. Likewise, opposing ends of the second support 550 can be coupled with the first and second linkages 510, 520. The first and second supports 540, 550 can be parallel to one another.

Figure 8:
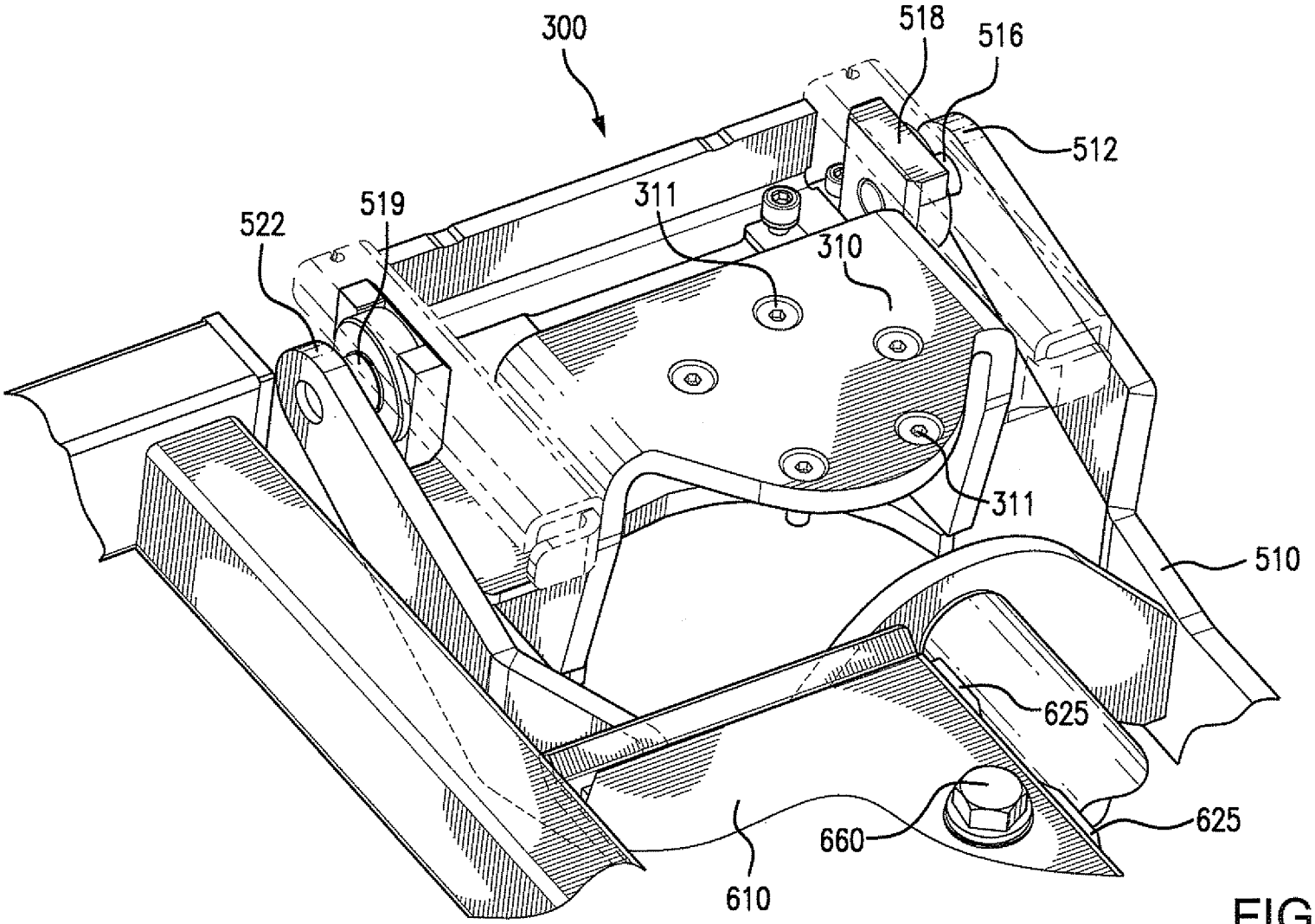
FIG. 8 is another perspective view of the second lifter head assembly of FIG. 7.
Figure 9:
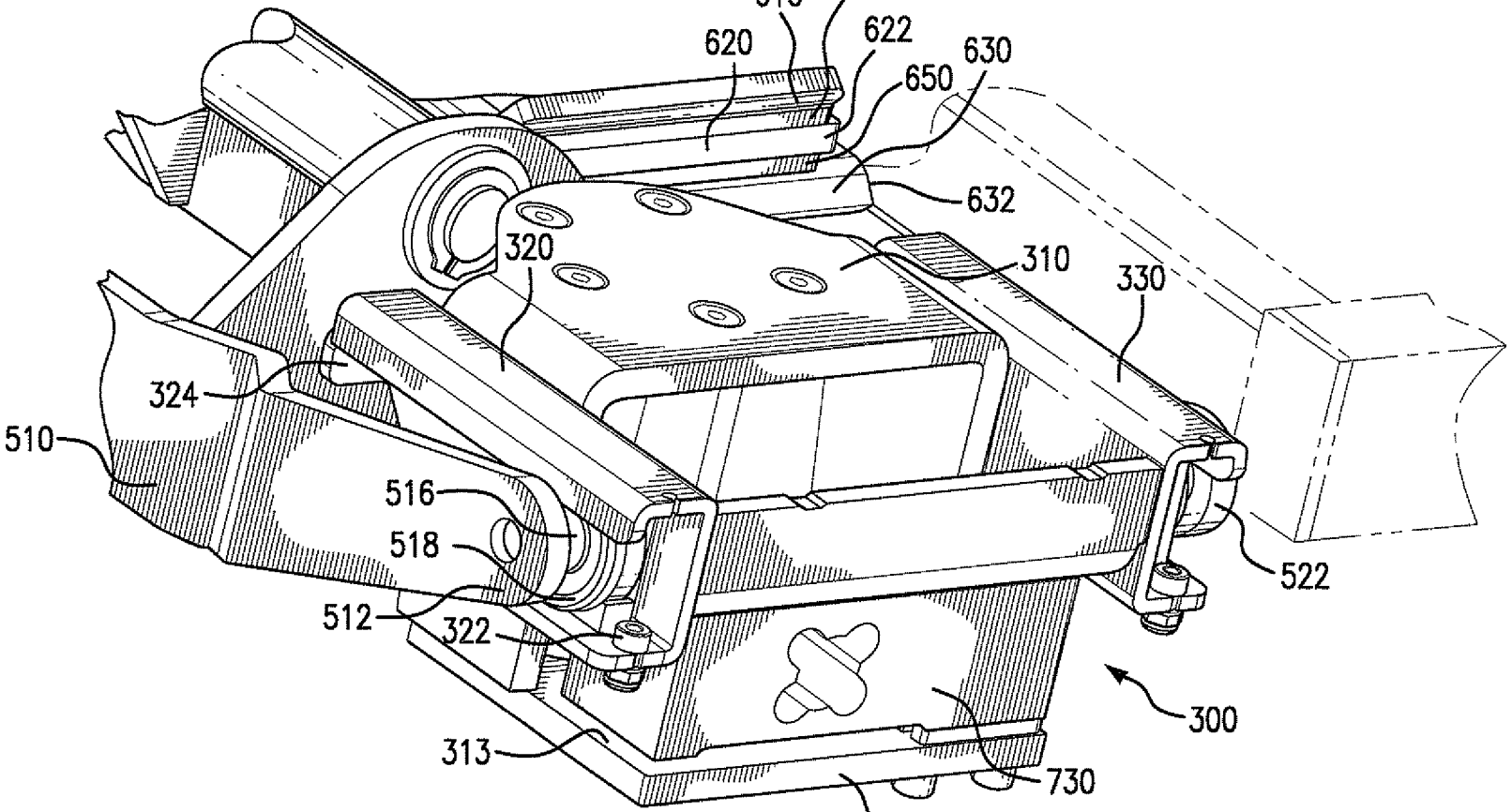
FIG. 9 is another perspective view of the second lifter head assembly of FIGS. 7 and 8.

The arm 500 can be coupled with the patient surface frame 100 by a plate assembly 600. As shown in FIGS. 7-9, the plate assembly 600 can include a first outer plate 610 and a second outer plate 630 disposed opposite the first outer plate 610. Disposed between the first and second outer plates 610, 630 are an interior plate 620 and first and second shim plates 640, 650. The interior plate 620 is disposed between the first and second shim plates 640, 650.

One surface of the first shim plate 640 can be adjacent to the first outer plate 610 and an opposing surface of the first shim plate 640 can be adjacent to the interior plate 620. In one embodiment, the first shim plate 640 can be in contact with the first outer plate 610 and the interior plate 620. One surface of the second shim plate 650 can be adjacent to the second outer plate 630 and an opposing surface of the second shim plate 650 can be adjacent to the interior plate 620. In one embodiment, the second shim plate 650 can be in contact with the second outer plate 630 and the interior plate 620.

Each of the first and second outer plates 610, 630, the interior plate 620, and the first and second shim plates 640, 650 can be rectangular in shape. Alternatively, other suitable shapes can be used. A first end 612 of the first outer plate 610 can be coupled with lateral frame member 130 of the patient surface frame 100. A second end 614 of the first outer plate 610 is disposed opposite of first end 612. The second end 614 of the first outer plate 610 does not contact the shaft 530 of the arm 500. A first end 632 of the second outer plate 630 can be coupled with lateral frame member 130 of the patient surface frame 100. A second end (not shown) of the second outer plate 630 does not contact the shaft 530 of the arm 500. The first outer plate 610 can be disposed above the second outer plate 630 such that perimeters of the first and second outer plates 610, 630 can be substantially coextensive with one another.

A first end 622 of the interior plate 620 does not contact the lateral frame member 130. A second end 624 of the interior plate 620 can extend beyond the second end 614 of the first outer plate 610 and the second end of the second outer plate 630. The second end 624 of the interior plate 620 can be coupled with the shaft 530 of the arm 500. As shown, the second end 624 of the interior plate 620 is fixedly attached to the shaft 530 by spot welds 625. Other suitable methods of attachment or connection can be used.

A pin assembly 660 can join together the first and second outer plates 610, 630, the interior plate 620, and the first and second shim plates 640, 650. The interior plate 620 can pivot about the pin assembly 660. Thus, there can be movement of the arm 500 with respect to the patient surface frame 100. The movement of the interior plate 620 is limited by contact of the first end 622 of the interior plate 620 with the lateral frame member 130. The shim plates 640, 650 remain stationary. The first and second shim plates 640, 650 can be formed of a different material than the interior plate 620 to facilitate movement of the interior plate 620. In one embodiment, the first and second shim plates 640, 650 can be made of a plastic material while the interior plate 620 can be made of metal. Other suitable materials can be used.

The first and second linkages 510, 520 can extend between the first and second lifter head assemblies 300, 400. As will be discussed in further detail, the first and second linkages 510, 520 are coupled with the first and second lifter head assemblies 300, 400.

Referring now to FIG. 7, the first linkage 510 includes a first end 512 and a second end 514 opposite the first end 512. The first end 512 of the first linkage 510 can be slidably and pivotably coupled with the second lifter head assembly 300. The second end 514 of the first linkage 510 can be pivotably coupled with the third lifter head assembly 400.

The second linkage 520 includes a first end 522 and a second end 524 opposite the first end 522. The first end 522 of the second linkage 520 can be slidably and pivotably coupled with the second lifter head assembly 300. The second end 524 of the second linkage 520 can be pivotably coupled with the third lifter head assembly 400.

Referring now to FIG. 8, the second lifter head assembly 300 can be coupled with the second end of the second lifter. The second lifter head assembly 300 can include a substantially planar cover plate 310. The cover plate 310 can be parallel to the undercarriage frame. The cover plate 310 can be fixedly attached to the second end of the second lifter by one or more mechanical fasteners 311, such as rivets, screws, or pins. The cover plate 310 also can be attached to the second lifter by welding. Other suitable methods of attachment can be used. Alternatively, the cover plate 310 can be integrally formed with the second lifter.

As better seen in FIG. 9, a flange 312 depends from the cover plate 310. The flange 312 can be a separate component that is coupled with the cover plate 310. Alternatively, the cover plate 310 and the flange 312 can be integrally formed. The flange 312 can include a load-cell-supporting surface 313. Thus, the load-cell-supporting surface 313 can be coupled with the second end of the second lifter. The load-cell-supporting surface 313 can be parallel to the cover plate 310. The load-cell-supporting surface 313 can be parallel to the undercarriage frame.

A third load cell 730 can be disposed in communication with the load-cell-supporting surface 313 of the flange 312. In another embodiment, the third load cell 730 can be coupled with the load-cell-supporting surface 313 of the flange 312. Alternatively, the third load cell 730 can be supported by and fixedly attached to the load-cell-supporting surface 313 of the flange 312. The load cell 730 can be adapted to communicate a signal associated with a force exerted from the patient surface frame 100.

As mentioned above, the first and second linkages 510, 520 can be slidably coupled with the second lifter head assembly 300. The connection of the first and second linkages 510, 520 to the second lifter head assembly 300 are substantially similar. Therefore, only the connection of the first linkage 510 will be described.

The second end 512 of the first linkage 510 can be attached to a bearing assembly 518 with a pin 516. In one embodiment, the second end 512 of the first linkage 510 can rotate with respect to the second lifter head assembly 300 about the axis defined by the pins 516 and 519. This axis of rotation can be parallel to the longitudinal axis of the patient surface frame 100.

The bearing assembly 518 can be configured to reciprocate within a first channel 320 transversely to the longitudinal axis of the patient surface frame 100. Travel of the bearing assembly 518 can be guided by first channel 320. Travel of the bearing assembly 518 can be limited by a first bearing limiter 322 at one end of the first channel 320 and a second bearing limiter 324 at an opposite end of the first channel 320. The first bearing limiter 322 can be a rivet, screw, or pin. The second bearing limiter 324 can be integrally formed with or connected to the first channel 320. Other suitable means for arresting or limiting travel of the bearing assembly 518 can be used.

The first channel 320 can be connected to or integrally formed with the second lifter head assembly 300. A second channel 330 also can be connected to or integrally formed with the second lifter head assembly 300. The first and second channels 320, 330 are connected together and parallel to one another.

Referring again to FIG. 7, the third lifter head assembly 400 can be coupled with the second end of the third lifter. The third lifter head assembly 400 can include a substantially planar cover plate 410. The cover plate 410 can be fixedly attached to the second end of the third lifter by one or more mechanical fasteners 411, such as rivets, screws, or pins. The cover plate 410 also can be attached to the third lifter by welding. Other suitable methods of attachment can be used. Alternatively, the cover plate 410 can be integrally formed with the third lifter.

A flange 412 depends from the cover plate 410. The flange 412 can be a separate component that is coupled with the cover plate 410. Alternatively, the cover plate 410 and the flange 412 can be integrally formed. The flange 412 can include a load-cell-supporting surface 413. Thus, the load-cell-supporting surface 413 can be coupled with the second end of the third lifter. The load-cell-supporting surface 413 can be parallel to the cover plate 410. The load-cell-supporting surface 413 can be parallel to the undercarriage frame.

A fourth load cell 740 can be disposed in communication with the load-cell-supporting surface 413 of the flange 412. In another embodiment, the fourth load cell 740 can be coupled with the load-cell-supporting surface 413 of the flange 412. Alternatively, the fourth load cell 740 can be supported by and fixedly attached to the load-cell-supporting surface 413 of the flange 412. The load cell 740 can be adapted to communicate a signal associated with a force exerted from the patient surface frame 100.

The second end 514 of the first linkage 510 can be pivotably coupled with the third lifter head assembly 400 by a pin 517. The second end 524 of the second linkage 520 can be pivotably coupled with the third lifter head assembly 400 by a pin 527. In one embodiment, the second end 524 of the second linkage 520 can rotate with respect to the third lifter head assembly 400 about the axis defined by the pins 517 and 527. This axis of rotation can be parallel to the longitudinal axis of the patient surface frame 100.

The load-cell-supporting surfaces 313, 413 are thus configured to remain parallel to the undercarriage frame as the patient surface frame 100 moves and rotates with respect to the undercarriage frame throughout a range of motion, which includes both horizontal and non-horizontal positions of the patient surface frame 100. Therefore, the force exerted from the patient surface frame 100 is perpendicular to each of the load cells 730, 740 not only when the patient surface frame 100 is parallel to the undercarriage frame, but also when the patient surface frame 100 is oblique to the undercarriage frame. Thus, the patient weight measured by each of the load cells 730, 740 is accurate regardless of the position of the patient surface frame 100 without the need to correct the force measured or to calculate a corrected weight.

A method according to an embodiment of the present invention will be described next. The method can be used to make a patient care bed configured to move within a predetermined range of motion, similar to that described above. However, the method can be used to make patient care beds other than those described above and shown in the attached figures. The embodiments described above may be referred to in describing the method to aid understanding.

The method can include providing an undercarriage frame and providing at least two lifters. Each of the lifters can comprise a first end and a second end. The lifters can be telescoping or height-adjustable lifters. The method also can include coupling the first ends of the lifters with the undercarriage frame, providing a patient surface frame opposite the undercarriage frame, coupling the second ends of the lifters with the patient surface frame, and providing a load-cell-supporting surface parallel to the undercarriage frame. In one embodiment, the load-cell-supporting surface remains parallel with respect to the undercarriage frame throughout the range of motion. A position of the patient surface frame can be oblique to the undercarriage frame. Another position of the patient surface frame can be parallel to the undercarriage frame.

The foregoing description of the exemplary embodiments, including preferred embodiments, of the invention has been presented only for the purposes of illustration and description and is not intended to be exhaustive or to limit the invention to the precise forms disclosed. Numerous modifications and adaptations thereof will be apparent to those skilled in the art without departing from the spirit and scope of the invention.

That which is claimed:

1. A bed comprising:

an undercarriage frame;

a patient surface frame opposite the undercarriage frame;

a plurality of height-adjustable lifters disposed between the undercarriage frame and the patient surface frame and configured to move independently of one another, each of the plurality of height-adjustable lifters comprising a first end coupled with the undercarriage frame and a second end coupled with the patient surface frame, the plurality of height-adjustable lifters configured to move the patient surface frame with respect to the undercarriage frame in a predetermined range of motion;

at least one load-cell-supporting surface disposed parallel to the undercarriage frame and coupled with the second end of one of the plurality of height-adjustable lifters, wherein the load-cell-supporting surface remains parallel to the undercarriage frame throughout the range of motion, and wherein the range of motion comprises a position where the patient surface frame is rotated about its longitudinal and transversal axes so that it is oblique to the undercarriage frame;

wherein the plurality of height-adjustable lifters comprises a first height-adjustable lifter intersecting a longitudinal axis of the patient surface frame, a second height-adjustable lifter, and a third height-adjustable lifter; and wherein the second and third height-adjustable lifters are coupled by an arm disposed transversely to the longitudinal axis of the patient surface frame, and wherein the arm is coupled with the patient surface frame via an intermediate plate structure.

2. The bed of claim 1 further comprising a load cell in communication with the load-cell-supporting surface, wherein the load cell is adapted to communicate a signal associated with a force exerted from the patient surface frame.

3. The bed of claim 2, wherein the load cell is coupled with the load-cell-supporting surface.

4. The bed of claim 1, wherein the second end of the first height-adjustable lifter comprises a substantially planar cover plate and first and second flanges depending from the cover plate, and wherein the first flange comprises a first load-cell-supporting surface and the second flange comprises a second load-cell-supporting surface.

5. The bed of claim 4, wherein the first and second load-cell-supporting surfaces are coplanar with one another and are parallel to the cover plate.

6. The bed of claim 5 further comprising a yoke pivotably coupled with the patient surface frame and slidably coupled with the second end of the first height-adjustable lifter.

7. The bed of claim 6, wherein the yoke is configured to reciprocate axially with respect to the longitudinal axis of the patient surface frame.

8. The bed of claim 1, wherein the second end of the second height-adjustable lifter comprises a substantially planar cover plate and a flange depending from the cover plate, and wherein the flange comprises a load-cell-supporting surface.

9. The bed of claim 8, wherein the second end of the third height-adjustable lifter comprises a substantially planar cover plate and a flange depending from the cover plate, and wherein the flange comprises a load-cell-supporting surface.

10. The bed of claim 9, wherein the load-cell-supporting surfaces of the second and third height-adjustable lifters are parallel to the undercarriage frame.

11. The bed of claim 10, wherein one end of the arm is pivotably and slidably coupled with the second end of the second height-adjustable lifter and an opposite end of the arm is pivotably coupled with the second end of the third height-adjustable lifter.

12. A bed comprising:

an undercarriage frame;

a plurality of lifters configured to move independently of one another, each of said lifters comprising first and second ends, the first ends of the lifters coupled with the undercarriage frame;

a patient surface frame coupled with the second ends of the lifters; and at least one load cell in communication with the patient surface frame, the load cell adapted to communicate a signal associated with a force exerted from the patient surface frame, wherein the force exerted from the patient surface frame is perpendicular to the load cell in a first position and a second position, and wherein the patient surface frame is rotated about its longitudinal and transversal axes so that it is oblique to the undercarriage frame in the second position;

wherein the plurality of lifters comprises a first height-adjustable lifter intersecting a longitudinal axis of the patient surface frame, a second height-adjustable lifter, and a third height-adjustable lifter; and wherein the second and third height-adjustable lifters are coupled by an arm disposed transversely to the longitudinal axis of the patient surface frame, and wherein the arm is coupled with the patient surface frame via an intermediate plate structure.

13. The bed of claim 12, wherein the patient surface frame is parallel to the undercarriage frame in the first position.

14. The bed of claim 13, wherein at least one flange depends from each one of the plurality of lifters, and wherein the flanges are parallel to the undercarriage frame in the first and second positions.

15. The bed of claim 14, wherein the at least one load cell is coupled with one of the flanges.

16. A method of making a bed configured to move within a predetermined range of motion, the method comprising:

providing an undercarriage frame;

providing a plurality of lifters configured to move independently of one another, each of the lifters comprising a first end and a second end;

coupling the first ends of the lifters with the undercarriage frame;

providing a patient surface frame opposite the undercarriage frame;

coupling the second ends of the lifters with the patient surface frame; and providing a load-cell-supporting surface parallel to the undercarriage frame, wherein the load-cell-supporting surface remains parallel with respect to the undercarriage frame throughout the range of motion, and wherein the range of motion comprises a position where the patient surface frame is rotated about its longitudinal and transversal axes so that it is oblique to the undercarriage frame;

wherein the plurality of lifters comprises a first height-adjustable lifter intersecting a longitudinal axis of the patient surface frame, a second height-adjustable lifter, and a third height-adjustable lifter; and wherein the second and third height-adjustable lifters are coupled by an arm disposed transversely to the longitudinal axis of the patient surface frame, and wherein the arm is coupled with the patient surface frame via an intermediate plate structure.

* * * * *